US005919064A

United States Patent [19]

Petersen et al.

[11] Patent Number: 5,919,064

[45] Date of Patent: Jul. 6, 1999

[54] CARD EDGE CONNECTOR WITH SIMILAR SHAPED CANTILEVERED BEAM SPRING CONTACTS HAVING MULTI-LEVEL CONTACT AREAS

[75] Inventors: Carl C. Petersen, Mentor, Ohio; Ronald P. Sidor, Stratford, Conn.

[73] Assignee: Framatome Connectors USA Inc., Fairfield, Conn.

[21] Appl. No.: 08/858,928

[22] Filed: May 20, 1997

[51] Int. Cl.[6] ..... H01R 23/70

[52] U.S. Cl. ..... 439/637

[58] Field of Search ..... 439/637, 60

[56] References Cited

U.S. PATENT DOCUMENTS

| | | | |
|---|---|---|---|
| 3,654,737 | 4/1972 | Primorac | 439/176 |
| 4,367,006 | 1/1983 | Rehbogen, Jr. et al. | 339/176 MF |
| 4,846,734 | 7/1989 | Lytle | 439/637 |
| 4,891,023 | 1/1990 | Lopata | 439/637 |
| 4,894,022 | 1/1990 | Guckenheimer | 439/260 |
| 4,996,766 | 3/1991 | Piorunneck et al. | 29/842 |
| 5,024,609 | 6/1991 | Piorunnck | 439/637 |
| 5,026,292 | 6/1991 | Pickles et al. | 439/108 |
| 5,040,991 | 8/1991 | Collier | 439/637 |
| 5,259,767 | 11/1993 | Kurbikoff et al. | 439/60 |
| 5,425,658 | 6/1995 | White | 439/637 |
| 5,433,616 | 7/1995 | Walden | 439/62 |
| 5,522,737 | 6/1996 | Bunker et al. | 439/637 |

*Primary Examiner*—Steven L. Stephan
*Assistant Examiner*—J. F. Duverne
*Attorney, Agent, or Firm*—Perman & Green, LLP

[57] ABSTRACT

A card edge connector having a housing, first contacts, and second contacts. The first and second contacts each have mounting sections and cantilevered flexible sections. The mounting sections of the first and second contacts have different lengths. The cantilevered flexible sections of the first and second contacts have the same length and shape. The first and second contacts are inserted into the housing at the same time on a single carry strip to form multi-level contact areas.

11 Claims, 4 Drawing Sheets

CARD EDGE CONNECTOR WITH SIMILAR SHAPED CANTILEVERED BEAM SPRING CONTACTS HAVING MULTI-LEVEL CONTACT AREAS

BACKGROUND OF THE INVENTION

1. Field of the Invention

The present invention relates to electrical connectors and, more particularly, to a card edge connector.

2. Prior Art

U.S. Pat. No. 4,996,766 discloses a bi-level card edge connector. The upper and lower contacts are formed on a same carry strip in alternating fashion and inserted into the housing at the same time. U.S. Pat. No. 4,367,006 discloses a connector for flat cable with similar shaped spring contacts connected to a carry strip.

SUMMARY OF THE INVENTION

In accordance with one embodiment of the present invention, a card edge connector is provided comprising a housing, first contacts and second contacts. The housing has a card edge receiving area. The first contacts are connected to the housing and have a mounting section, a solder tail, and a flexible section. The flexible section extends from an end of the mounting section. The flexible section has a first daughter board contact area in the card edge receiving area. The second contacts are connected to the housing and have a mounting section, a solder tail, and a second flexible section. The second flexible section extends from an end of the mounting section and has a second daughter board contact area in the card edge receiving area. The flexible sections of the first and second contacts have a general cantilevered beam shape with the same length. The first and second daughter board contact areas are at different depths in the card edge receiving area.

In accordance with another embodiment of the present invention a card edge connector is provided having a housing and electrical spring contacts. The housing has a card edge receiving area. The spring contacts are connected to the housing and include a mounting section, a solder tail, and a deflectable contact arm. The spring contacts include first contacts with daughter board contact areas at a first depth in the card edge receiving area and second contacts with second daughter board contact areas at a second different depth in the card edge receiving area. The deflectable contact arms of the first and second contacts have a same length and shape between their mounting sections and the daughter board contact areas.

In accordance with a method of the present invention a method of manufacturing a card edge connector is provided comprising steps of providing a housing having a daughter board receiving area; stamping a strip of electrically conductive material to substantially simultaneously form first and second contacts connected at their bottom ends to a carry strip; inserting the first and second contacts to the housing at the same time in a single insertion operation to locate the first and second daughter board contact areas at different respective depths in the daughter board receiving area while still connected to the carry strip; and removing the carry strip from the first and second contacts after insertion of the first and second contacts into the housing.

BRIEF DESCRIPTION OF THE DRAWINGS

The foregoing aspects and other features of the present invention are explained in the following description, taken in connection with the accompanying drawings, wherein.

DETAILED DESCRIPTION OF THE PREFERRED EMBODIMENT

Figure 1:
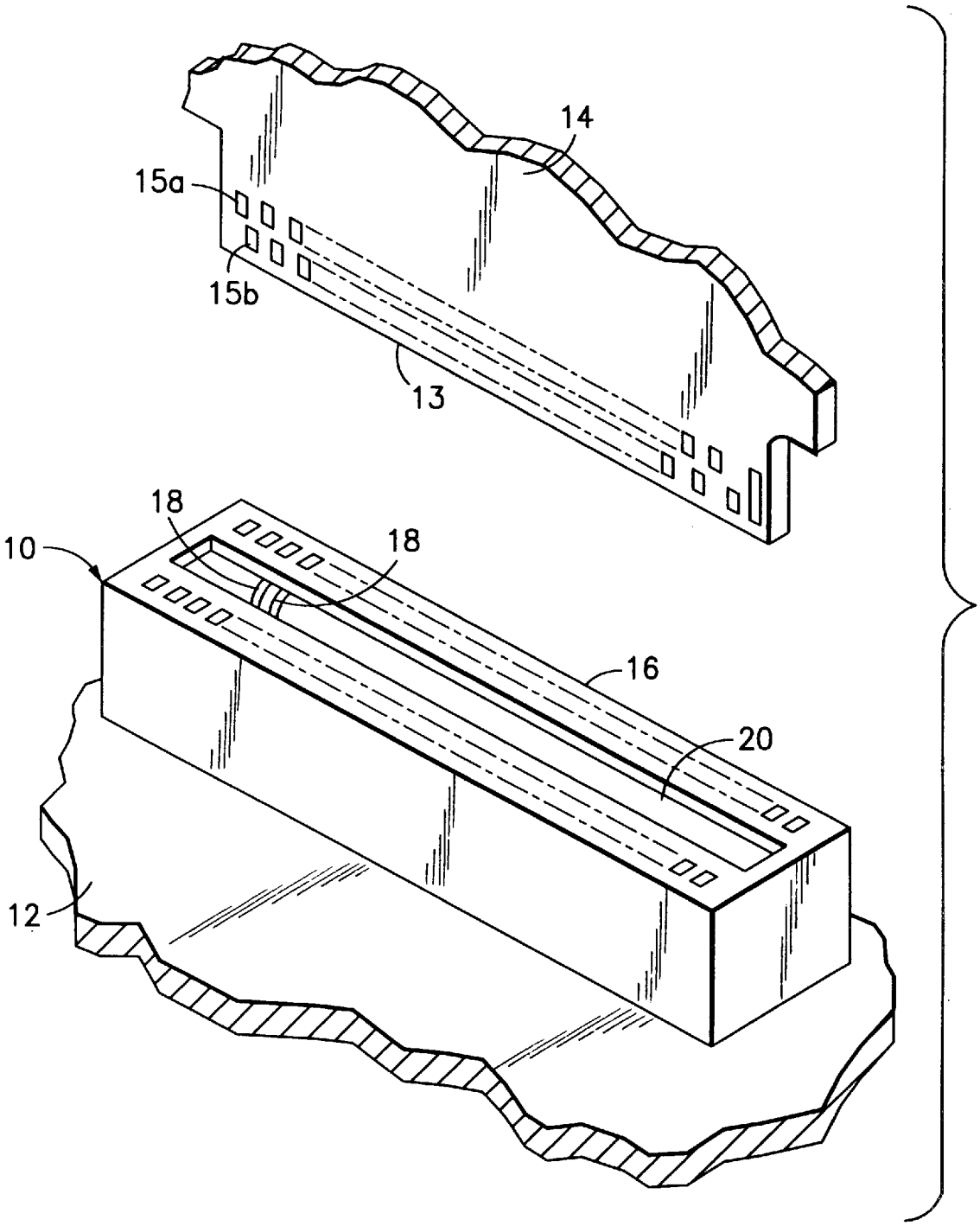
FIG. 1 is a perspective view of a card edge connector incorporating features of the present invention attached to a first printed circuit board for receiving an edge of a second printed circuit board.

Referring to FIG. 1, there is shown an exploded perspective view of a card edge connector 10 incorporating features of the present invention. Although the present invention will be described with reference to the single embodiment shown in the drawings, it should be understood that the present invention can be embodied in many alternate forms of embodiments. In addition, any suitable size, shape or type of elements or materials could be used.

Figure 2A:
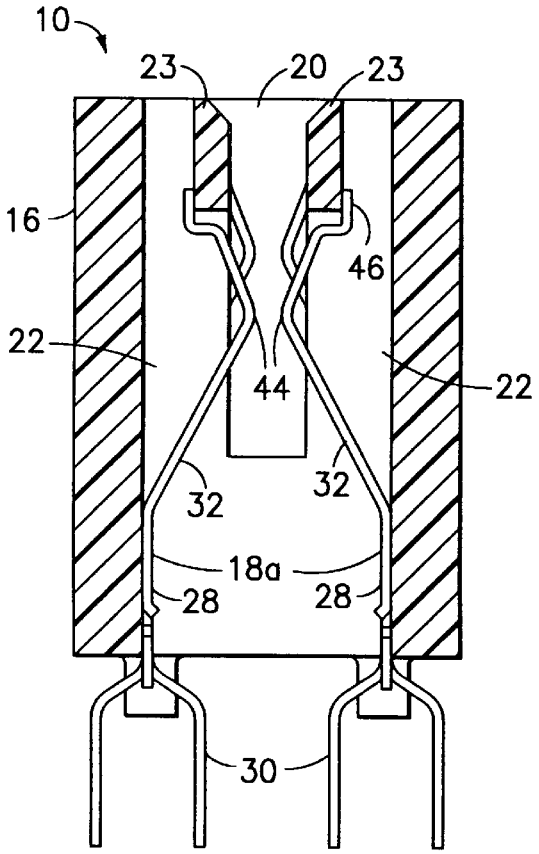
FIG. 2*a* is a cross-sectional view of the card edge connector shown in FIG. 1 showing the lower level contacts.
Figure 2B:
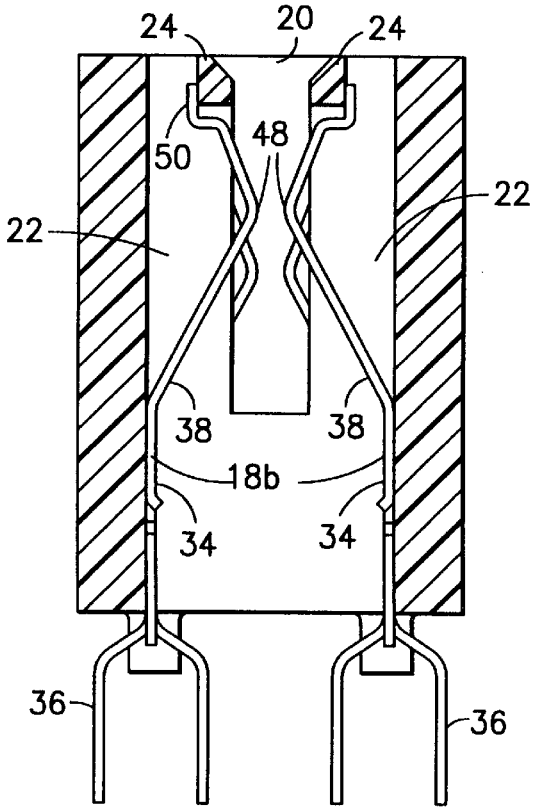
FIG. 2*b* is a cross-sectional view of the card edge connector shown in FIG. 1 showing the upper level contacts.

FIG. 1 shows the connector 10 mounted on a first printed circuit board 12 for removably receiving the second printed circuit board 14. The connector 10 includes a housing 16 and electrical contacts 18. The housing 16 has a card edge receiving area 20. The housing 16 is preferably comprised of a dielectric material such as molded plastic. The second printed circuit board 14 has an edge 13 that is suitably sized and shaped to be inserted into the slot 20. The edge 13 includes two rows of upper and lower contact pads 15*a*, 15*b*. Referring also to FIGS. 2*a* and 2*b*, the contacts 18 include lower level contacts 18*a* and upper level contacts 18*b*. The housing has contact receiving areas 22 located on opposite sides of the card edge receiving area 20. Located at the top of the contact receiving areas 22 are preload sections 23, 24. The first preload sections 23, in the contact receiving areas holding the lower level contacts 18*a* shown in FIG. 2*a*, have a longer height than the second preload sections 24 in the contact receiving areas holding the upper level contacts 18*b* shown in FIG. 2*b*.

Figure 3:
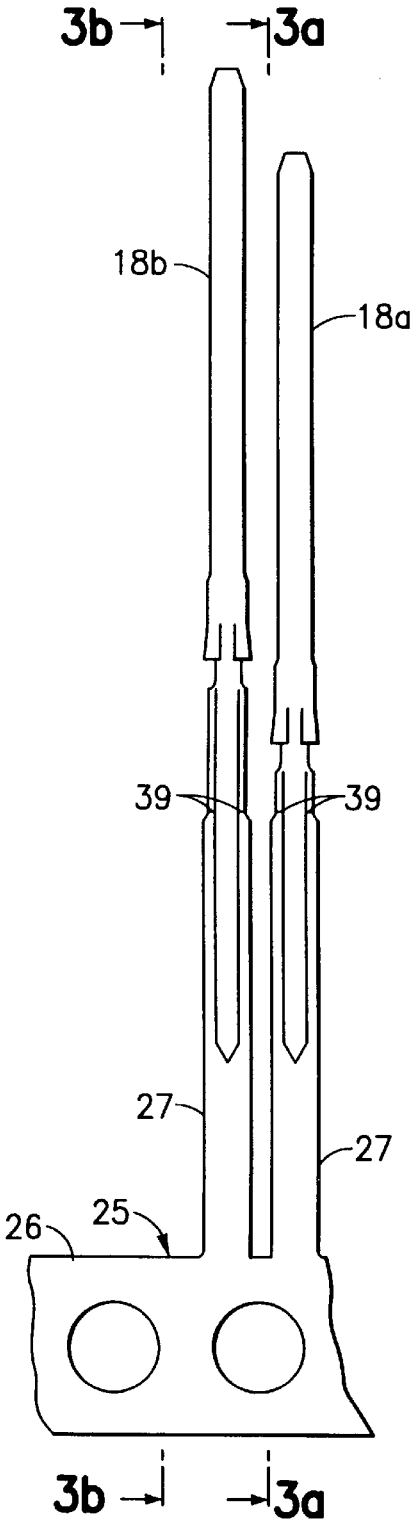
FIG. 3 is a side view of an electrical contact and carry strip member for use in manufacturing the card edge connector shown in FIG. 1.
Figure 3A:
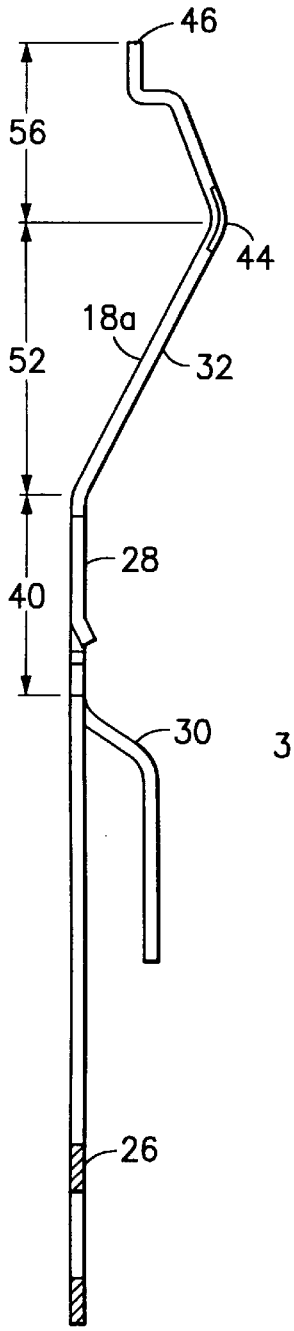
FIG. 3*a* is a cross-sectional view of the member shown in FIG. 3 taken along line 3*a*—3*a;*
Figure 3B:
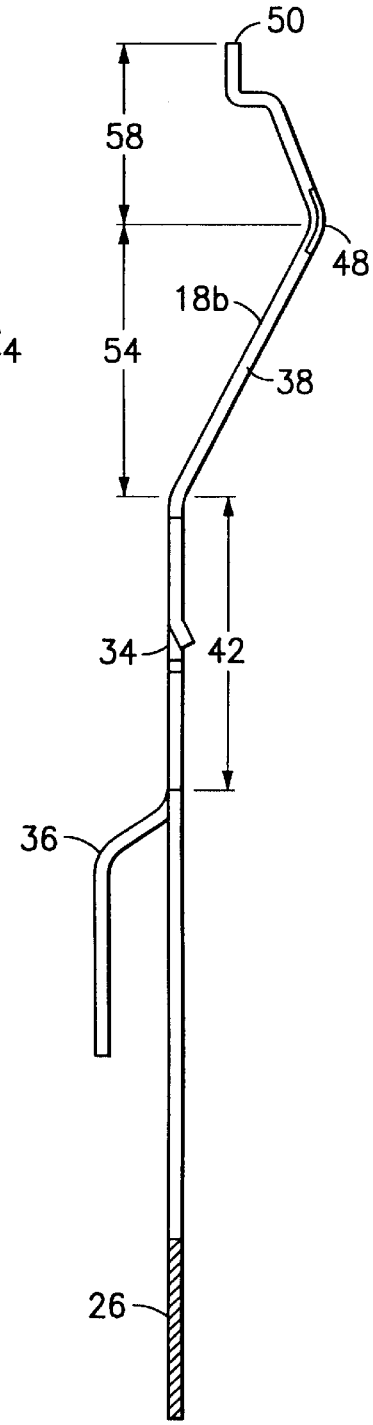
FIG. 3*b* is a cross-sectional view of the member shown in FIG. 3 taken along line 3*b*—3*b*.

Referring also to FIGS. 3, 3*a* and 3*b*, the upper and lower level contacts 18*a*, 18*b*, are preferably manufactured in a substantially simultaneously manner on a carry strip 26 as a series of alternating upper and lower contacts. The lower level contacts 18*a* generally comprise a mounting section 28, a solder tail 30, and a flexible section 32. The upper level contacts 18*b* generally comprise a mounting section 34, a solder tail 36, and a flexible section 38. The combined electrical contact and carry strip member 25 shown in FIG. 3 is made from a sheet metal member that is stamped to form the member 25. Similar to the method described in U.S. Pat. No. 4,996,766, the alternating upper and lower contacts can be inserted into the housing 16 at the same time. The carry strip 26 can then be removed from the contacts. U.S. Pat. No. 4,996,766 is hereby incorporated by reference in its entirety.

The spacing of adjacent contacts in the connector 10 is at a, centerline spacing of about 1 mm (0.039 inch). In the prior art connector described in U.S. Pat. No. 4,996,766, the centerline spacing between adjacent contacts was about 0.05 inch. Because the centerline spacing of adjacent contacts in the connector 10 is about 20% smaller than in the prior art EISA-type bi-level card edge connector, a problem was encountered with bending the lower level contacts at the reduced pitch of 1 mm. In particular, quality of the lower level contacts in a 1 mm pitch EISA-type connector could not be guaranteed. Therefore, a new connector needed to be invented that could accommodate the reduced contact pitch of 1 mm or less and, still provide the benefits of U.S. Pat. No. 4,996,766; i.e.: manufacture of multiple different types of contacts on a single carry strip for insertion into the housing with a single insertion operation. The present invention solves this problem.

In the embodiment shown, the mounting sections 28, 34 of the two types of contacts 18*a*, 18*b*, are different. In particular, the mounting section 28 of the lower level contact 18*a* has a length 40 that is shorter than the length 42 of the upper level contact's mounting section 34. However, the bottom ends of the two mounting sections 28, 34 are both the same distance from the carry strip 26. Break areas 39 are formed between the bottoms of the mounting sections 28, 34 and the connecting portions 27 of the carry strip 26. When the contacts 18*a*, 18*b* are inserted into the housing 16, their mounting sections 28, 34 make an interference fit with the housing 16 to fixedly and stationarily mount the mounting sections 28, 34 to the housing 16.

In the embodiment shown, the solder tails 30, 36 are through-hole solder tails. However, the solder tails could alternatively be surface mount solder tails. The solder tails 30, 36 extend from bottom ends of their respective mounting sections 28, 34. In the embodiment shown, the solder tails 30 of the lower level contacts 18*a* extend outward from one side of the member 25. The solder tails 36 of the upper level contacts 18*b* extend outward from an opposite side of the member 25. Thus, when the contacts are inserted into a row of the contact receiving areas 22 of the housing 16, they form two staggered rows of solder tails for each row. However, in alternate embodiments, any suitable solder tail arrangement could be provided. The flexible sections 32, 38 extend from the opposite upper ends of their respective mounting sections 28, 34.

The flexible sections 32, 38, in the embodiment shown, are essentially identical to each other. The flexible sections 32, 38 are deflectable contact arms with a general cantilevered beam shape. The lower level contact 18*a* has a lower level daughter board contact area 44 and a top end 46 with a stepped shape. The upper level contact 18*b* has an upper level daughter board contact area 48 and a top end 50 with a stepped shape. The lower level contact flexible section 32 has a length 52 between the lower level daughter board contact area 44 and the mounting section 28. The flexible section 38 of the upper level contact 18*b* has an exact same length 54 between its daughter board contact area 48 and its mounting section 34. Likewise, the length 56 between the lower level daughter board contact area 44 and the top end 46 is the same as the length 58 between the upper level daughter board contact area 48 and the top end 50. Thus, the two flexible sections 32, 38 have the exact same length and shape. However, as seen best by comparing FIG. 3*a* to FIG. 3*b*, the flexible sections 32, 38 are located at different distances from the carry strip 26 and from their respective solder tails 30, 36. The reason for these different locations is because of the different length mounting sections 40, 42.

As noted above, one of the features of the present invention is insertion of the two types of contacts 18*a*, 18*b*, into a row of contact receiving areas 22 at the same time. This is done by keeping the carry strip 26 attached to the contacts 18*a*, 18*b* during insertion and then removing the carry strip 26 from the contacts after they have been inserted into the housing 16. Because the bottom ends of the mounting sections 28, 34 are the same distance from the carry strip, when the contacts 18*a* 18*b* are inserted into the housing 16 the bottom ends of the mounting sections 28, 34 are located at the same location and position relative to the housing. The two mounting sections 28, 34 because of their different lengths, are inserted into the housing 16 at different depths of insertion. Because the two mounting sections 28, 34 are inserted into the housing at different depths of insertion, and because the flexible sections 32, 38 have the same shape and length, the two daughter board contact areas 44, 48 are located at different depths in the card edge receiving area 20. Thus, a multi-level card edge connector is provided with deflectable cantilevered arms having the same shape and length. The longer preload sections 23 are provided such that the top ends 46 of the lower level contacts 18*a* can be preloaded against the housing. Likewise, the shorter preload sections 24 are provided such that the top ends 50 of the upper level contacts 18*b* can be preloaded against the housing.

As noted above, the centerline spacing between adjacent contacts 18*a*, 18*b* in each row is preferably about 1 mm or smaller. By manufacturing the contacts 18*a*, 18*b*, with the same shape flexible sections 32, 38, but making the lengths of the mounting sections 40, 42 different, the different types of contacts 18*a*, 18*b*, can be formed on a single carry strip, in alternating fashion, and still be inserted into a row of the housing 16 at the same time in a single insertion operation. This type of connector manufacture method provides a connector with a reduced contact pitch, but at a considerable cost saving than if the different types of contacts had to be manufactured separately and inserted separately for each row in the housing. In alternate embodiments, other types of shapes of the mounting sections and/or flexible sections could be provided. The two top ends 46, 50 need not be the same and the preload sections 23, 24 could have the same shape and size.

Figure 4:
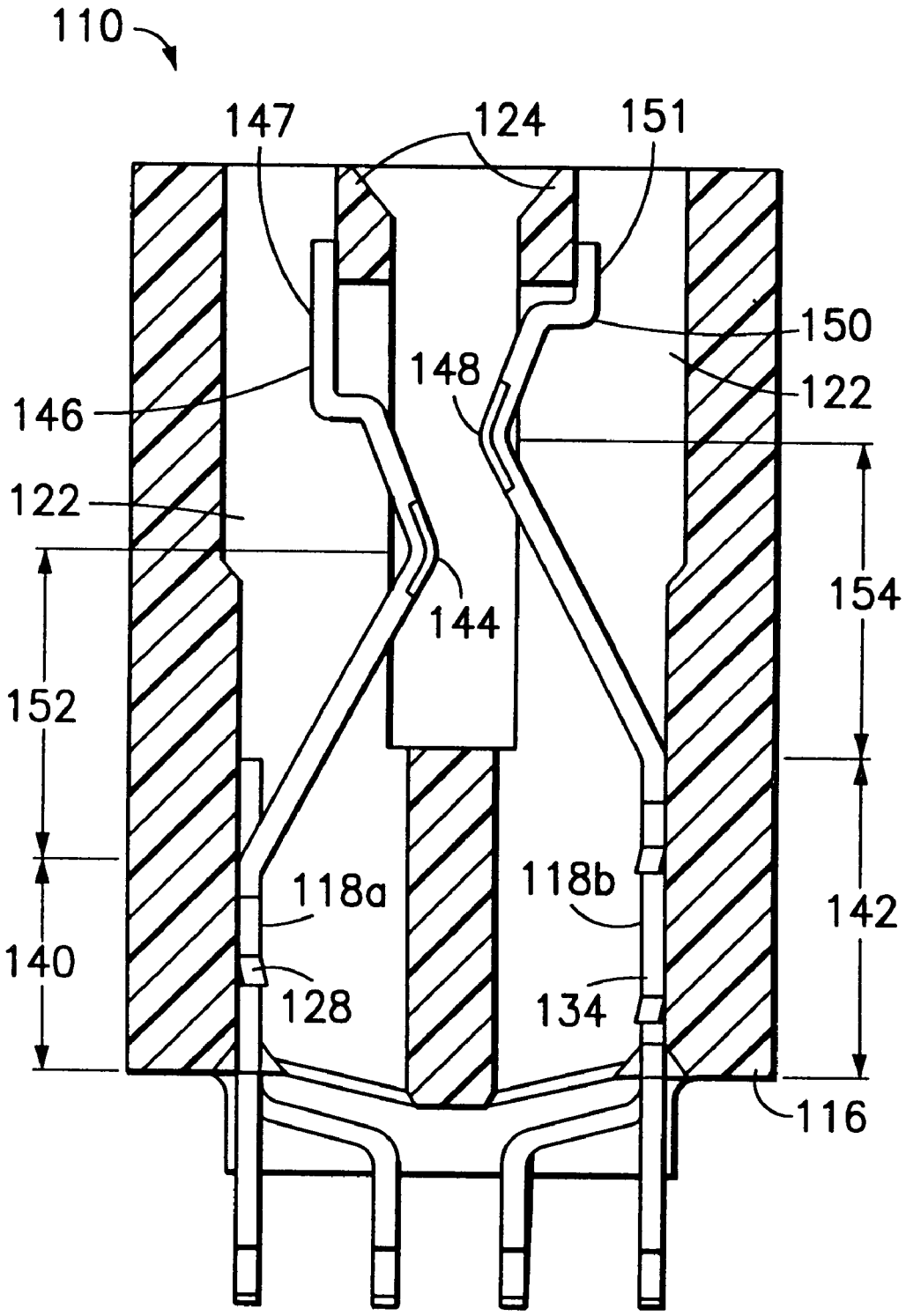
FIG. 4 is a cross-sectional view of an alternate embodiment of a card edge connector incorporating features of the present invention.

Referring to FIG. 4, a cross-sectional view of alternate embodiment of a card edge connector 100 incorporating features of the present invention is shown. In this embodiment the housing 116 has uniform length preload sections 124 in each contact receiving area 122. Each pair of opposing areas 122 have opposing upper and lower level contacts 118*a*, 118*b*. The lower level contact 118*a* has a mounting section 128 with a first length 140. The upper level contact 118*b* has a mounting section 134 with a second longer length 142. The lower level contact 118*a* has a working length 152 between the mounting section 128 and the lower daughter board contact area 144. The upper level contact 118*b* has a working length 154 between the mounting section 134 and the upper daughter board contact area 148. The two working lengths 152 and 154 are the same. The upper level contact 118*b* has a top end 150 with substantially the same shape and proportions as the top end 50 shown in FIG. 3*b* with a short leg 151. The lower level contact 118*a* has a top end 146 with an elongated leg 147. The two legs 147, 151 are prestressed against the preload sections 124. Similar to the contact strip shown in FIG. 3, the contacts 118*a*, 118*b* are manufactured on a carry strip for insertion into a row of the receiving areas 122 at the same time. The contacts 118*a*, 118*b* have the same length and shape between mounting sections 128, 134 and contact areas 144, 148. However, the contact areas 144, 148 are located at different depths in the card edge receiving area because of the different length mounting sections 128, 134.

It should be understood that the foregoing description is only illustrative of the invention. Various alternatives and modifications can be devised by those skilled in the art without departing from the invention. Accordingly, the present invention is intended to embrace all such alternatives, modifications and variances which fall within the scope of the appended claims.

What is claimed is:

1. A card edge connector comprising:

a housing having a card edge receiving area comprising a slot into the housing;

first contacts connected to the housing, the first contacts each having a first mounting section stationarily connected to the housing, a first solder tail section extending from one end of the first mounting section, and a first flexible section extending from another end of the first mounting section, the first flexible section having a first daughter board contact area in the card edge receiving area; and second contacts connected to the housing, the second contacts each having a second mounting section stationarily connected to the housing, a second solder tail section extending from one end of the second mounting section, and a second flexible section extending from another end of the second mounting section, the second flexible section having a second daughter board contact area in the card edge receiving area;

wherein the flexible sections of the first and second contacts have a general cantilevered beam shape with the same length and, the first and second daughter board contact areas are at different depths in the card edge receiving area, wherein the flexible sections of the first and second contacts have the same shape, and wherein top ends of the first and second contacts at ends of their respective flexible sections are preloaded against the housing.

2. A connector as in claim 1 wherein the flexible sections of the first and second contacts have the exact same length and shape between their respective mounting sections and their respective first and second daughter board contact areas.

3. A connector as in claim 2 wherein the flexible sections of the first and second contacts have the exact same length and shape between their respective daughter board contact areas and their respective top ends.

4. A connector as in claim 1 wherein the mounting section of the first contacts extend into the housing at a first depth and the mounting section of the second contacts extend into the housing at a second different depth.

5. A connector as in claim 4 wherein the mounting section of the first contacts has a first length and the mounting section of the second contacts has a second different length.

6. A connector as in claim 1 wherein the first and second contacts are stamped from a same strip of electrically conductive material in an alternating arrangement with a centerline spacing of about 1 mm on a carry strip and are inserted into the housing at the same time while connected to the carry strip.

7. A card edge connector comprising:

a housing having a card edge receiving area; and electrical spring contacts connected to the housing, the contacts each having a mounting section stationarily connected to the housing, a solder tail extending from one end of the mounting section, and a deflectable contact arm extending from another end of the mounting section, wherein the spring contacts include first contacts with first daughter board contact areas on their respective deflectable contact arms at a first depth in the card edge receiving area, second contacts with second daughter board contact areas on their respective deflectable contact arms at a second different depth in the card edge receiving area, and wherein the deflectable contact arms of the first and second contacts have a same length and shape between the mounting sections and the daughter board contact areas, wherein the deflectable contact arms of the first and second contacts have the exact same length and shape, and wherein top ends of the first and second contacts are preloaded against the housing at ends of their deflectable contact arms.

8. A connector as in claim 7 wherein the mounting sections of the first and second contacts have different lengths.

9. A connector as in claim 7 wherein the mounting sections of the first and second contacts extend into the housing at different depths of insertion.

10. A connector as in claim 7 wherein the deflectable contact arms have a general cantilevered beam shape.

11. A connector as in claim 7 wherein the first and second contacts are stamped from a same strip of electrically conductive material in an alternating arrangement with a centerline spacing of about 1 mm on a carry strip and are inserted into the housing at the same time while connected to the carry strip.

* * * * *